US007102475B2

(12) United States Patent
Nakagawa et al.

(10) Patent No.: US 7,102,475 B2
(45) Date of Patent: Sep. 5, 2006

(54) MAGNETIC ACTUATOR

(75) Inventors: Takafumi Nakagawa, Tokyo (JP); Mitsuru Tsukima, Tokyo (JP); Toshie Takeuchi, Tokyo (JP); Kenichi Koyama, Tokyo (JP); Tetsuya Matsuda, Tokyo (JP); Nobumoto Tohya, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/642,517

(22) Filed: Aug. 18, 2003

(65) Prior Publication Data

US 2005/0088265 A1 Apr. 28, 2005

(30) Foreign Application Priority Data

Aug. 27, 2002 (JP) ..... 2002-246335
Feb. 21, 2003 (JP) ..... 2003-043838

(51) Int. Cl.
*H01F 7/08* (2006.01)

(52) U.S. Cl. ..... 335/234; 335/229

(58) Field of Classification Search ..... 335/220–234, 335/236, 256, 261–262
See application file for complete search history.

(56) References Cited

U.S. PATENT DOCUMENTS 4,635,016 A * 1/1987 Guery et al. ..... 335/230
4,829,947 A * 5/1989 Lequesne ..... 123/90.11
6,009,615 A * 1/2000 McKean et al. ..... 29/602.1
6,084,492 A * 7/2000 Cereda et al. ..... 335/229

FOREIGN PATENT DOCUMENTS

DE 43 04 921 C1 8/1994
WO WO 01/09912 A2 2/2001

* cited by examiner

*Primary Examiner*—Lincoln Donovan
(74) *Attorney, Agent, or Firm*—Leydig, Voit & Mayer, Ltd.

(57) ABSTRACT

A magnetic actuator includes a first yoke, an armature which is provided inside the first yoke and made movable in reciprocating motion along a first direction inside the first yoke, first and second coils fitted inside the first yoke, a pair of second yokes affixed to the first yoke along a second direction, and permanent magnets affixed to the second yokes in a manner that the permanent magnets are positioned face to face with the armature. In the magnetic actuator thus constructed, fluxes generated by the first and second coils pass through first magnetic circuits whereas fluxes generated by the permanent magnets pass through second magnetic circuits differing from the first magnetic circuits.

20 Claims, 18 Drawing Sheets

CONTACTS CLOSED
(COILS UNEXCITED)

ARMATURE BEING MOVED
(2ND COIL BEING EXCITED)

CONTACTS OPENED
(COILS UNEXCITED)

CONTACTS CLOSED
(COILS UNEXCITED)

ARMATURE BEING MOVED
(2ND COIL BEING EXCITED)

CONTACTS OPENED
(COILS UNEXCITED)

"PRIOR ART"

CONTACTS CLOSED
(COILS UNEXCITED)

"PRIOR ART"

ARMATURE BEING MOVED
(2ND COIL BEING EXCITED)

"PRIOR ART"

CONTACTS OPENED
(COILS UNEXCITED)

"PRIOR ART"

"PRIOR ART"

MAGNETIC ACTUATOR

BACKGROUND OF THE INVENTION

1. Field of the Invention

This invention relates to an actuator for driving a circuit breaker used in an electric power transmission and distribution system, and in particular to a magnetic actuator provided with permanent magnets and electromagnetic coils.

2. Description of the Background Art

FIG. 19 is a diagram generally showing the construction of a conventional electric circuit breaker system 500 of which example is shown in European Patent Publication No. EP0721650 B1.

Referring to the Figure, the circuit breaker system 500 includes a magnetic actuator 100, a circuit breaker 200 which is connected to the magnetic actuator 100 for opening and closing breaker contacts 210, and springs 300 and 301 provided at the top and bottom of the magnetic actuator 100, respectively. These springs 300, 301 assist the working of the circuit breaker 200 when the magnetic actuator 100 causes the circuit breaker 200 to open and close its contacts 210.

FIG. 18 shows principal components of the magnetic actuator 100 of FIG. 19. As depicted in the Figure, the magnetic actuator 100 includes a yoke 250 built up of ferromagnetic laminations, each produced by punching a magnetic steel sheet to form a left-hand yoke section 201, a right-hand yoke section 202, an upper yoke section 203 and a lower yoke section 204. The magnetic actuator 100 further includes permanent magnets 205, an armature 206 which is made movable inside the yoke 250 over a specific stroke, and first and second coils 207, 208. The permanent magnets 205 are attached to solid inner yokes 201*b* and 202*b* provided on pole portions 201*a* and 202*a* projecting inward from the left-hand yoke section 201 and the right-hand yoke section 202, respectively. The first and second coils 207, 208 used in the magnetic actuator 100 have an equal magnetomotive force (AT). The armature 206 is connected to an actuator rod 209 which passes through the upper and lower yoke section 203, 204 and is joined to the circuit breaker 200. There are provided air gaps g between the armature 206 and the permanent magnets 205. It is to be noted that FIG. 18 shows an example in which the circuit breaker 200 is provided at the top of the magnetic actuator 100 unlike the example shown in FIG. 19.

Let us assume that the armature 206 is currently held at a first position 203*a* adjacent to the upper yoke section 203 by a magnetic field produced by the permanent magnets 205. When the second coil 208 is excited in such a manner that it produces a magnetic field of the same polarity as the magnetic field produced by the permanent magnets 205, a holding force exerted on the armature 206 by the permanent magnets 205 is canceled out and, as a consequence, the armature 206 moves by as much as the aforementioned specific stroke down to the lower yoke section 204. Then, if the second coil 208 is de-excited, the armature 206 is now held at a second position 204*a* adjacent to the lower yoke section 204 by the magnetic field produced by the permanent magnets 205. Here, the aforementioned specific stroke of the armature 206 is of an amount which is necessary to break the contacts 210 of the circuit breaker 200, for example.

In the example depicted in FIG. 18, the armature 206 is held at the second position 204*a* adjacent to the lower yoke section 204, forming an air gap G between the armature 206 and the upper yoke section 203. The spring 301 shown in FIG. 19 assists in opening the contacts 210 of the circuit breaker 200 via the actuator rod 209 when the armature 206 begins to move as a result of excitation of the second coil 208. On the other hand, the spring 300 assists in closing the contacts 210 of the circuit breaker 200 when closing the contacts 210 from an open position shown in FIG. 19.

When the first coil 207 is excited, the armature 206 moves toward the upper yoke section 203 causing the contacts 210 to close and becomes held at the first position 203*a* adjacent to the upper yoke section 203.

The principle of operation of the armature 206 is now discussed with reference to FIGS. 17A–17C. These Figures also show an example in which the circuit breaker 200 is provided at the top of the magnetic actuator 100 unlike the example shown in FIG. 19.

(1) The contacts 210 of the circuit breaker 200 are in a closed position in FIG. 17A, in which the armature 206 is held at the first position 203*a* adjacent to the upper yoke section 203 and neither the first coil 207 nor the second coil 208 is excited. The letters "N" in the Figure indicate north poles formed by the permanent magnets 205 on surfaces of the armature 206 and the letters "S" indicate south poles formed by the permanent magnets 205 on surfaces of the pole portions 201*a*, 202*a* shown in FIG. 18. Under these conditions, the permanent magnets 205 generate fluxes $\Phi_{PM1}$ and $\Phi_{PM2}$ passing through magnetic circuits L1 and L2, respectively. Since the magnetic circuit L1 has a lower reluctance than the magnetic circuit L2, the flux $\Phi_{PM1}$ is much greater than the flux $\Phi_{PM2}$ ($\Phi_{PM1} >> \Phi_{PM2}$), so that a magnetic attractive force occurs between the armature 206 and the upper yoke section 203. This magnetic attractive force is expressed by $F=\Phi^2/S/\mu_0=Bg^2S/\mu_0$, where Bg is the flux density within the air gap G and S is the facing area of the upper yoke section 203 and the armature 206.

(2) When the second coil 208 is excited in this condition, fluxes $\Phi coil_{2-1}$ and $\Phi coil_{2-2}$ are generated as shown in FIG. 17B. These fluxes $\Phi coil_{2-1}$, $\Phi coil_{2-2}$ are combined with the fluxes $\Phi_{PM1}$, $\Phi_{PM2}$ generated by the permanent magnets 205. If a relationship expressed by $\Phi_{PM2}+\Phi coil_{2-1}>\Phi_{PM1}-\Phi coil_{2-2}$ is satisfied, there occurs a force pulling the armature 206 toward the lower yoke section 204.

(3) When the armature 206 comes apart from the upper yoke section 203, the sum of the fluxes $\Phi_{PM2}+\Phi coil_{2-1}$ becomes much greater than the sum of the fluxes $\Phi_{PM1-\Phi coil2-2}$ ($\Phi_{PM2}+\Phi coil_{2-1}>>\Phi_{PM1}-\Phi coil_{2-2}$), whereby the armature 206 is caused to move by as much as the aforementioned specific stroke and reach the second position 204*a* adjacent to the lower yoke section 204 as shown in FIG. 17C.

(4) If the second coil 208 is de-excited at this point, the flux $\Phi_{PM1}$ becomes much less than the-flux $\Phi_{PM2}$ ($\Phi_{PM1} << \Phi_{PM2}$), whereby the armature 206 is held at the second position 204*a* adjacent to the lower yoke section 204 as shown in FIG. 17C.

When the armature 206 moves by as much as the aforementioned specific stroke within the yoke 250 as discussed above, a current flowing in an electric power transmission and distribution system is interrupted by opening the contacts 210 of the circuit breaker 200 which is linked to the actuator rod 209 directly connected to the armature 206.

To bring the contacts 210 from the open position shown in FIG. 17C back to the closed position shown in FIG. 17A, the first coil 207 is excited so that the armature 206 moves up to the first position 203*a* adjacent to the upper yoke section 203 according to the same principle of operation as described above. The first coil 207 is de-excited at this point and the armature 206 is held at the first position 203*a* by the flux $\Phi_{PM1}$ generated by the permanent magnets 205, whereby the contacts 210 of the circuit breaker 200 are closed and a current flows normally.

In the magnetic actuator 100 used in the conventional circuit breaker system 500 described above, the permanent magnets 205 for holding the armature 206 at the first or second position 203*a*, 204*a* are attached to the pole portions 201*a* and 202*a* via the solid inner yokes 201*b* and 202*b*, respectively. In this construction, the permanent magnets 205 exist in the magnetic circuits L1 and L2 formed by the first and second coils 207, 208 for actuating the armature 206 and, therefore, eddy currents occur in the permanent magnets 205 and the inner yokes 201*b*, 202*b* when an exciting power supply (not shown) is turned on and off.

These eddy currents produce such a problem that they cause not only deterioration of response characteristics of the magnetic actuator 100 but also an increase in the size and cost of the aforementioned exciting power supply.

SUMMARY OF THE INVENTION

In light of the foregoing, it is a principal object of the invention to minimize the occurrence of eddy currents by providing permanent magnets in different magnetic circuits than magnetic circuits for driving an armature. It is a more particular object of the invention to provide a magnetic actuator driven by a compact and inexpensive power supply, in which a first yoke constitutes part of an armature driving magnetic circuit formed by exciting a coil, and second yokes constitute part of an armature holding magnetic circuit formed by permanent magnets to achieve improved response characteristics.

It is another object of the invention to achieve improved control characteristics of a magnetic actuator by creating different magnetic gaps between a yoke and an armature provided inside the yoke in open and closed positions of circuit breaker contacts.

It is a further object of the invention to reduce the weight and cost of the magnetic actuator by making the cross-sectional area of a lower yoke section smaller than that of an upper yoke section and differentiating magnetomotive forces generated by first and second coils.

According to the invention, a magnetic actuator includes a first yoke made of an assembly of laminated metal sheets, a pair of second yokes affixed to the first yoke, permanent magnets affixed to the second yokes, an armature provided inside the first yoke, a first coil fitted in the first yoke, and a second coil fitted in the first yoke. The armature is made movable in reciprocating motion over a specific stroke between a first position and a second position along a first direction inside the first yoke. The armature constitutes first magnetic circuits of fluxes generated by the first or second coil together with the first yoke and moves toward the first or second position when the first or second coil is excited. The permanent magnets are located in second magnetic circuits of fluxes generated by the permanent magnets, the second magnetic circuits passing through the permanent magnets, the first yoke, the second yokes and the armature. The armature is held at the first or second position by the fluxes generated by the permanent magnets.

In the magnetic actuator thus constructed, the first yoke forms part of the first magnetic circuits through which the fluxes generated by either the first or second coil pass, while the permanent magnets affixed to the second yokes form part of the second magnetic circuits through which the fluxes generated by the permanent magnets pass. This construction makes it possible to provide a magnetic actuator featuring improved response characteristics.

These and other objects, features and advantages of the invention will become more apparent upon reading the following detailed description along with the accompanying drawings.

DETAILED DESCRIPTION OF THE PREFERRED EMBODIMENTS OF THE INVENTION

First Embodiment

A magnetic actuator 100 according to a first embodiment of the invention is described with reference to FIGS. 1A–1B to 6A–6B and 8A–8C.

Figure 1A:
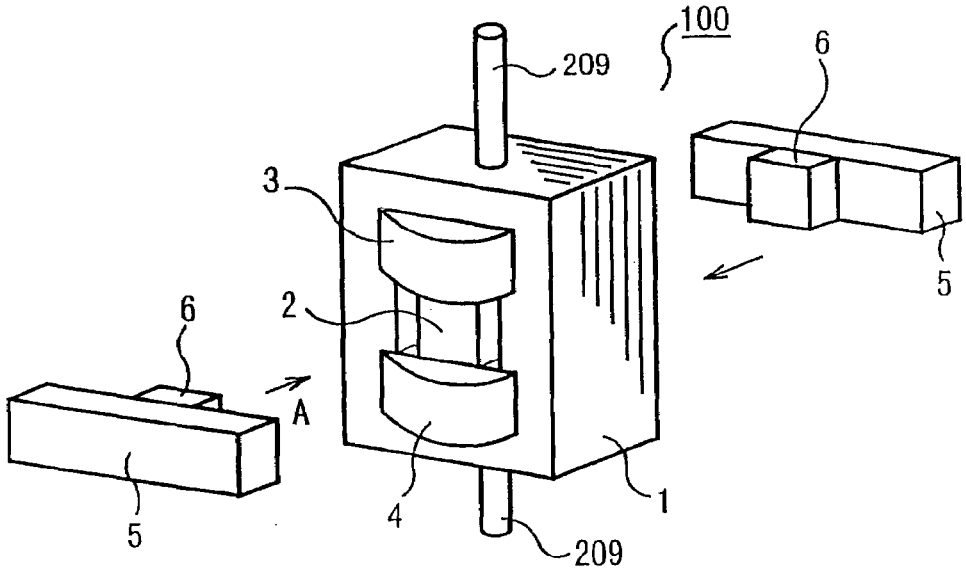
FIGS. 1A–1B are partially exploded perspective views of a magnetic actuator according to a first embodiment of the invention.
Figure 1B:
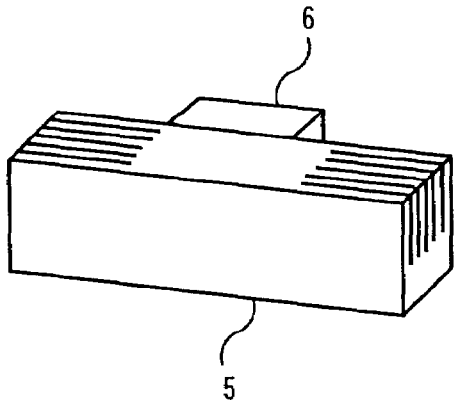
Figure 2:
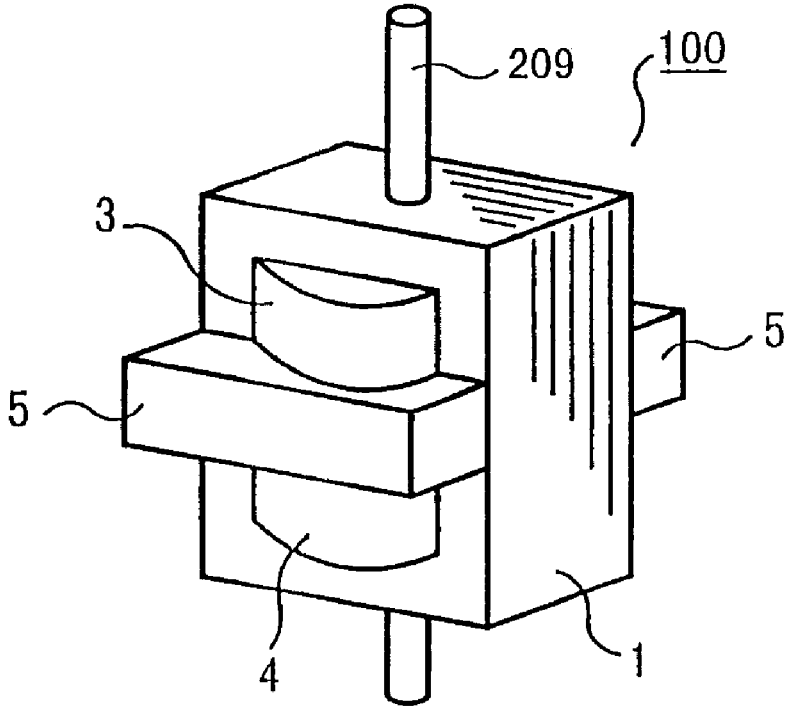
FIG. 2 is a perspective view of the magnetic actuator of the first embodiment.
Figure 3A:
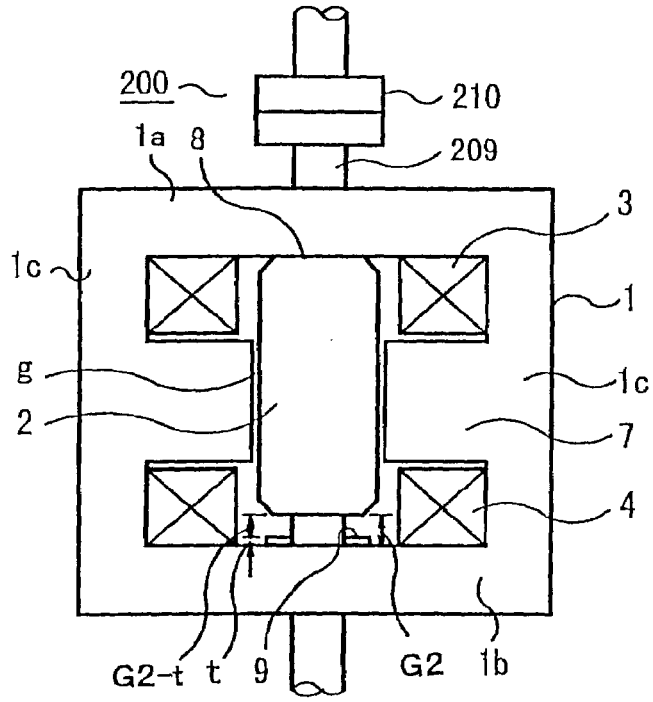
FIGS. 3A–3B are sectional diagrams generally showing a yoke and armature arrangement of the magnetic actuator of the first embodiment.
Figure 3B:
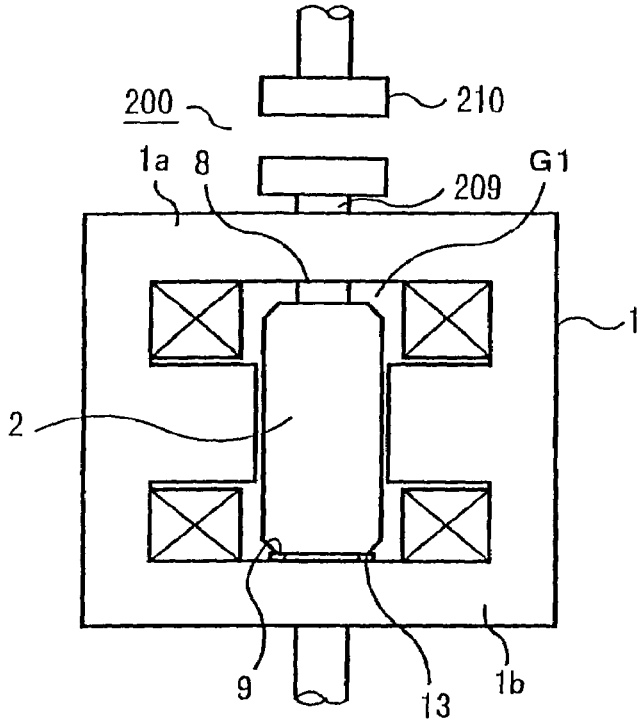

FIG. 1A–1B is a partially exploded perspective view of the magnetic actuator 100, FIG. 2 is a perspective view of the magnetic actuator 100, and FIGS. 3A–3B are sectional diagrams generally showing a yoke and armature arrangement.

Referring to these Figures, the magnetic actuator 100 includes a first yoke 1 formed of an upper yoke section 1*a*, a lower yoke section 1*b* and side yoke sections 1*c*, an armature 2, a first coil 3, a second coil 4, a pair of second yokes 5, a pair of permanent magnets 6 and left and right poles 7. The numerals 8 and 9 indicate first and second positions of the armature 2, respectively. Designated by the numeral 209 is a rod which passes through the upper and lower yoke sections 1*a*, 1*b* and is joined to the armature 2 at the bottom and to one of contacts 210 of a circuit breaker 200 at the top.

The first yoke 1 is built up of ferromagnetic laminations, each produced by punching a thin magnetic steel sheet to form the upper yoke section 1*a*, the lower yoke section 1*b*, the side yoke sections 1*c* and the poles 7 in a single structure. The first position 8 of the armature 2 is located at the bottom surface of the upper yoke section 1*a* with which the armature 2 is held in direct contact, whereas the second position 9 of the armature 2 is located slightly above the top surface of the lower yoke section 1*b*.

The armature 2 is provided inside the first yoke 1 in a manner that the armature 2 can move up and down over a specific stroke along a first direction, or the vertical direction of FIG. 1A. The first and second coils 3, 4 are also provided inside the first yoke 1. The two second yokes 5 are mounted along a second direction perpendicular to the first direction with the side yoke sections 1*c* located in between.

The armature 2 is built up of laminations of thin magnetic steel or thin steel sheets and is connected to the actuator rod 209 which is linked to the circuit breaker 200. There are formed air gaps g between the armature 2 and the poles 7. The two second yokes 5 are made of solid steel plates having a rectangular shape in side view and attached to the side yoke sections 1*c* by bolts or fastening parts which are not illustrated. The permanent magnets 6 are attached to the respective second yokes 5 at the middle of their length. When assembled into the magnetic actuator 100, the individual permanent magnets 6 face the armature 2 across the same air gaps g as mentioned above.

FIG. 3A shows a state in which the armature 2 is held at the first position 8 adjacent to the upper yoke section 1*a* by the permanent magnets 6 attached to the second yokes 5. In this state, the contacts 210 of the circuit breaker 200 are closed. FIG. 3B, on the other hand, shows a state in which the armature 2 is held at the second position 9 adjacent to the lower yoke section 1*b* and the contacts 210 of the circuit breaker 200 are opened. There is formed a first air gap G1 between the top surface of the armature 2 and the upper yoke section 1*a* (the first position 8) in FIG. 3B, whereas there is formed a second air gap G2 between the bottom surface of the armature 2 and the lower yoke section 1*b* in FIG. 3A.

Figure 17A:
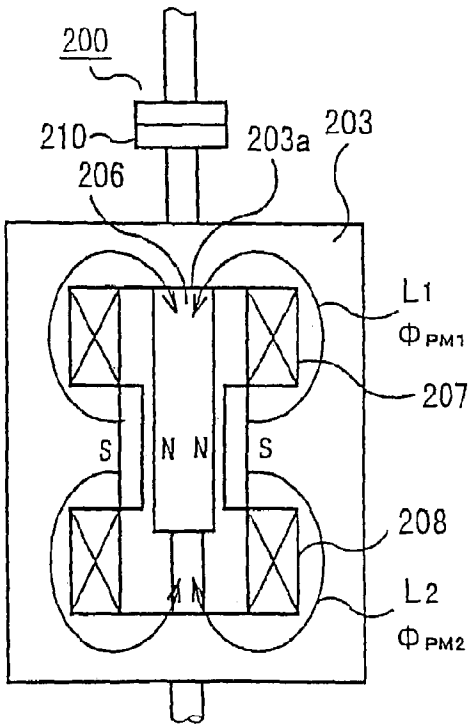
FIGS. 17A–17C are diagrams showing the principle of operation of a conventional magnetic actuator.
Figure 17B:
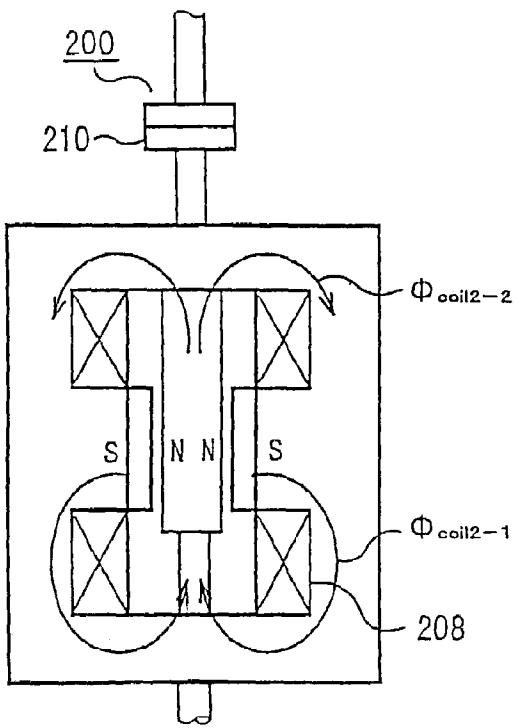
Figure 17C:
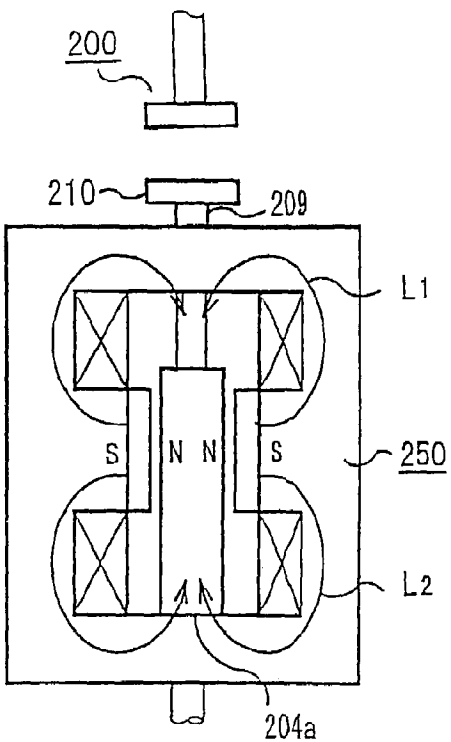
Figure 18:
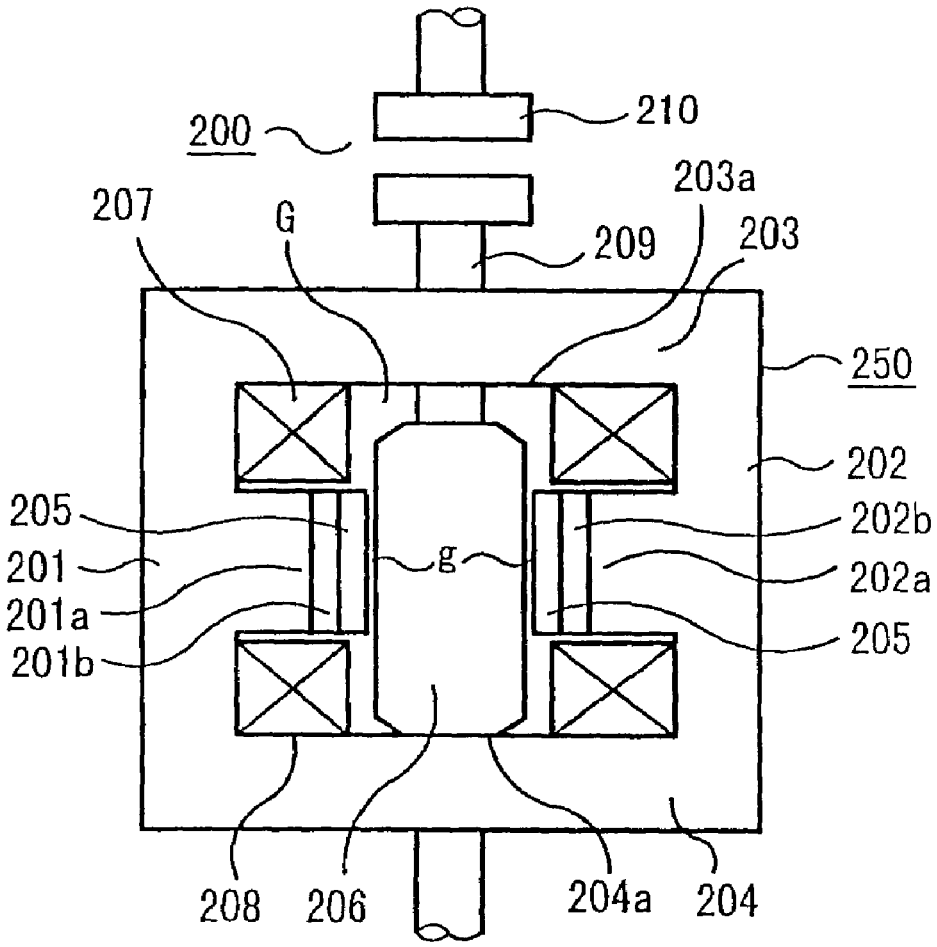
FIG. 18 a diagram showing principal components of the conventional magnetic actuator.

Described below is how the first yoke 1 and the second yokes 5 form magnetic circuits. The first coil 3 or the second coil 4, when excited by an exciting power supply (not shown), generates fluxes passing through first magnetic circuits formed through the interior of the first yoke 1 and the armature 2. These fluxes correspond to the fluxes $\Phi coil_{2-1}$, $\Phi coil_{2-2}$ of FIG. 17B mentioned in the foregoing description of the background art.

The fluxes passing through the first magnetic circuits cause the armature 2 to move up and down along the aforementioned first (vertical) direction of the first yoke 1. When switching the circuit breaker 200 from a closed position of the contacts 210 shown in FIG. 3A to an open position of the contacts 210 shown in FIG. 3B, the second coil 4 is excited to generate fluxes $\Phi coil_{2-1}$, $\Phi coil_{2-2}$ as shown in FIG. 8B. Consequently, the armature 2 is caused to move downward from the first position 8 adjacent to the upper yoke section 1*a* to the second position 9 adjacent to the lower yoke section 1*b* by as much as the aforementioned specific stroke which is equal to G2-t shown in FIG. 3A.

When switching the circuit breaker 200 from the open position of the contacts 210 shown in FIG. 3B to the closed position of the contacts 210 shown in FIG. 3A, on the other hand, the first coil 3 is excited to move the armature 2 upward. The first yoke 1 forms part of magnetic paths through which the fluxes generated by the first coil 3 or the second coil 4, whichever excited, pass as explained above. The first yoke 1 is therefore made of laminations of thin magnetic steel sheets to reduce eddy currents which could occur in the first yoke 1 as a result of excitation of the first or second coil 3, 4.

Figure 4:
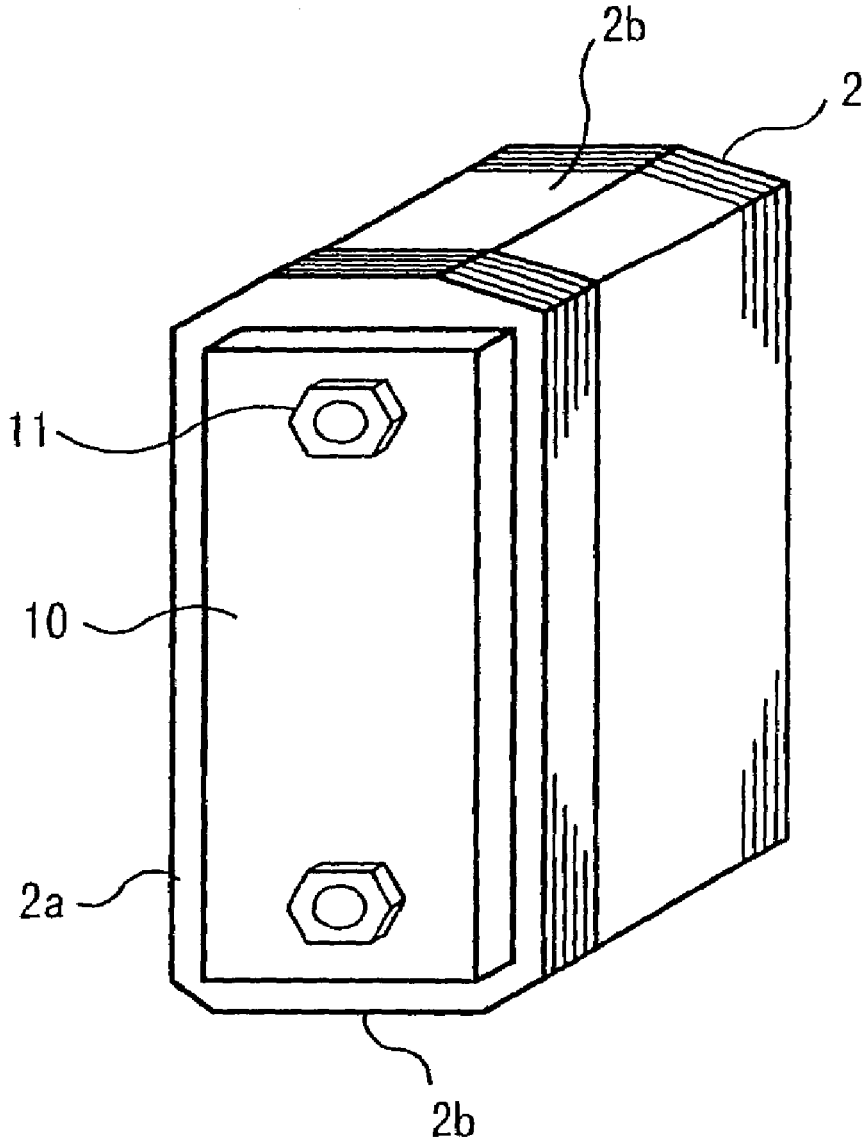
FIG. 4 is a perspective view of an armature of the magnetic actuator of the first embodiment.

The armature 2, which also forms part of the magnetic paths, is made of laminations of thin magnetic steel sheets for the same reason. These thin magnetic steel sheets are securely bound together by fastening bolts 11 with steel end plates 10 placed at both ends of the laminations as shown in FIG. 4.

Figure 20:
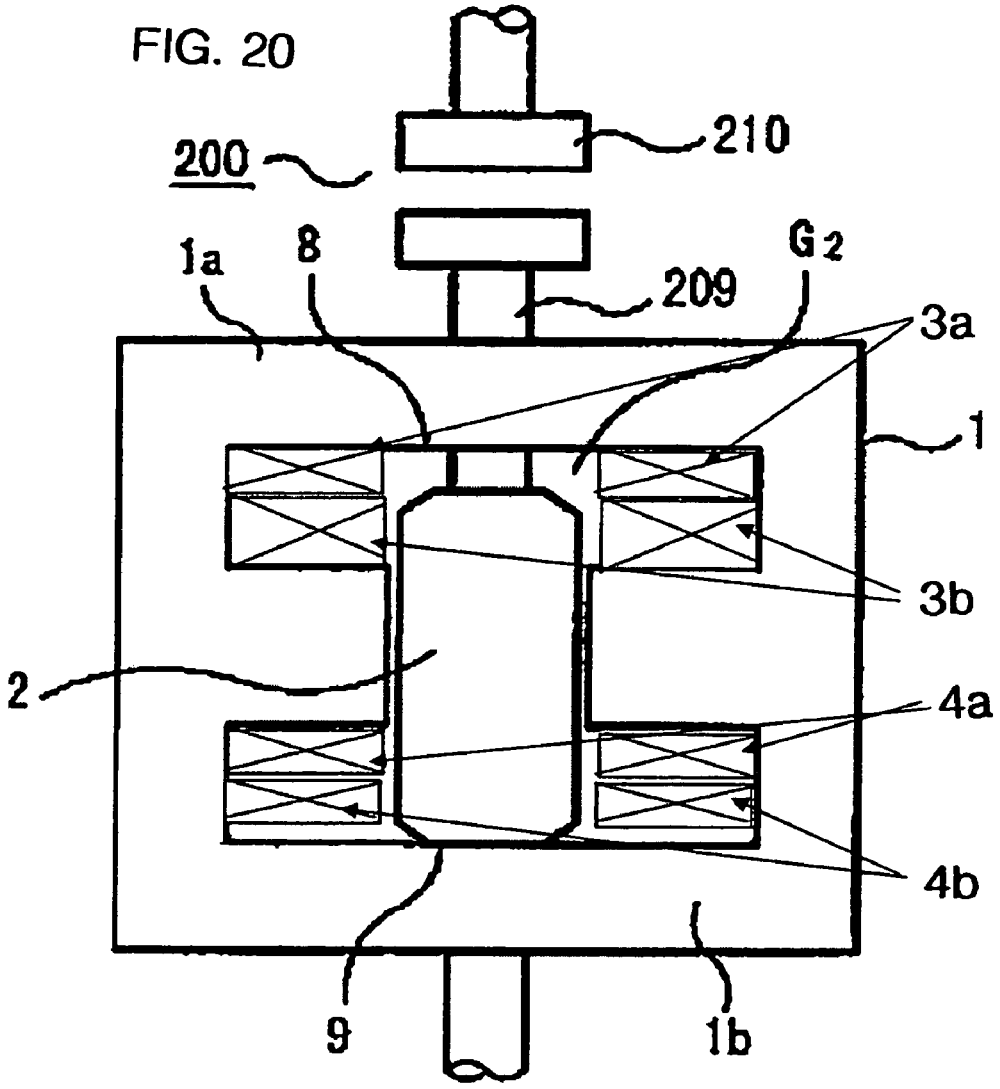
FIG. 20 is a cross-sectional view of an alternative first embodiment of the invention.

Each of the first and second coils 3, 4 may be a coil assembly formed of a set of multiple coils, or the first and second coils 3, 4 may be together formed by a set of multiple coils necessary for actuating the armature 2 that are arranged to produce desired control characteristics of the magnetic actuator 100. FIG. 20 shows such an arrangement in which the first coil 3 of FIG. 1 includes coils 3*a* and 3*b* and the second coil 4 of FIG. 1 includes coils 4*a* and 4*b* in FIG. 20. As an example, a third coil which performs the function of the first coil 3 may be provided at a location where the second coil 4 is provided.

The second yokes 5 are oriented along the second direction perpendicular to the first direction as shown in FIG. 1A. Fluxes formed by the permanent magnets 6 pass through second magnetic circuits, each formed from the second yoke 5 through the side yoke section 1*c*, the upper or lower yoke 1*a*, 1*b*, the armature 2, the permanent magnet 6 and back to the second yoke 5.

Figure 9:
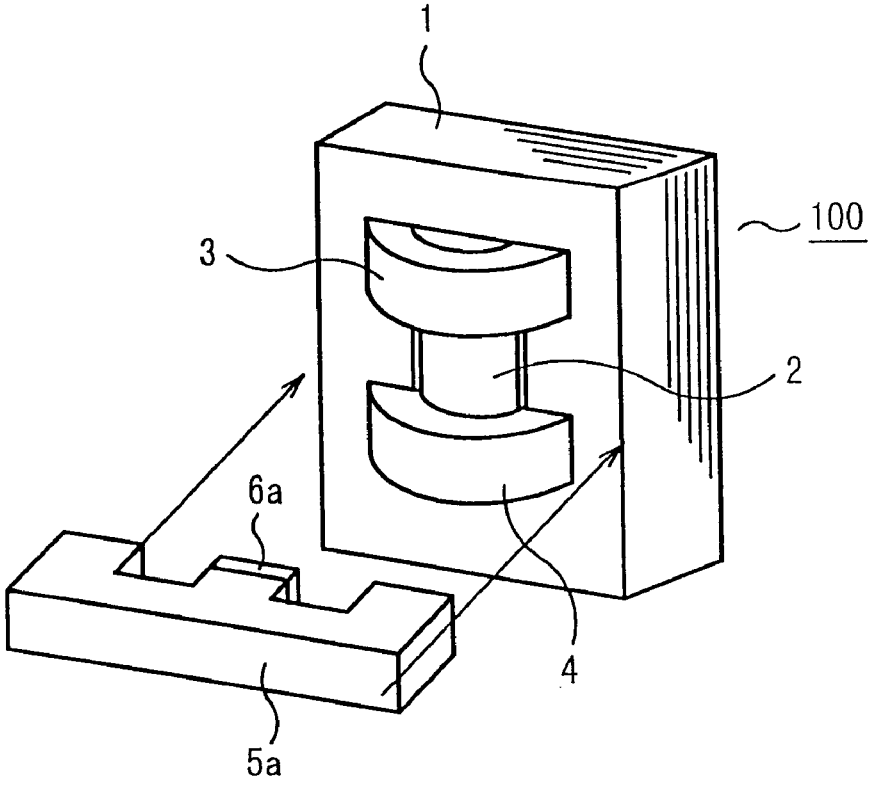
FIG. 9 is a partially exploded perspective view of the magnetic actuator according to the third embodiment of the invention.

Thus, the second yokes 5 of the first embodiment, as well as those of later described second to sixth embodiments, constitute part of the second magnetic circuits through which the fluxes generated by the permanent magnets 6 pass. However, the second yokes 5 constitute no part of the first magnetic circuits through which the fluxes generated by the first or second coil 3, 4 pass. This is because the permanent magnets 6 are located in the second magnetic circuits formed by the first yoke 1, the second yokes 5 and the armature 2, and not in the first magnetic circuits, as shown in FIGS. 1A, 9 and 10.

Therefore, although the second yokes 5 are made of solid steel plates as stated above, they are not necessarily limited to this structure, but as shown in FIG. 1B, may be made of laminations of thin magnetic steel or thin steel sheets taking into consideration the method and cost of manufacture. Furthermore, although the first yoke 1 and the armature 2 are built up of laminations of thin magnetic steel sheets in the present embodiment, they may be made of laminations of thin steel sheets. Moreover, although there is provided a pair of second yokes 5 in the present embodiment, the number of the second yokes 5 is not necessarily limited to two, but just a single second yoke 5 may be provided on one side of the first yoke 1.

Now, the construction of the armature 2 is discussed in detail. As shown in FIG. 4, both end portions 2*b* of the armature 2 located in the aforementioned first direction, or end surfaces of the armature 2 that are confined by the first yoke 1 at the first position 8 and the second position 9, are formed into a trapezoidal shape in side view. This means that the area of cross section of the armature 2 taken perpendicular to the first direction at the end portions 2*b* through which the fluxes pass is smaller than the other (middle) portion 2*a* of the armature 2. This structure makes is possible to optimize magnetic attractive forces exerted by the first and second coils 3, 4 on the armature 2 between the first and second positions 8, 9, thereby allowing an improvement in control characteristics of the magnetic actuator 100.

It is to be pointed out that although the end portions 2*b* of the armature 2 shown in FIG. 4 are trapezoid-shaped, the end portions 2*b* are not limited to this shape but may have a recessed or projecting cross-sectional shape, for instance. What is essential for the shape of the end portions 2*b* of the armature 2 is that the cross-sectional area of the end portions 2*b* through which the fluxes pass should be smaller than the middle portion 2*a* of the armature 2. Also, although the steel end plates 10 are provided at both ends of the armature 2 in this embodiment as shown in FIG. 4, three such steel plates may be provided at both ends and at the middle of the armature 2.

Now, an armature 2*c* according to a variation of the first embodiment is described referring to FIGS. 5A–5B and 6A–6C.

Figure 5A:
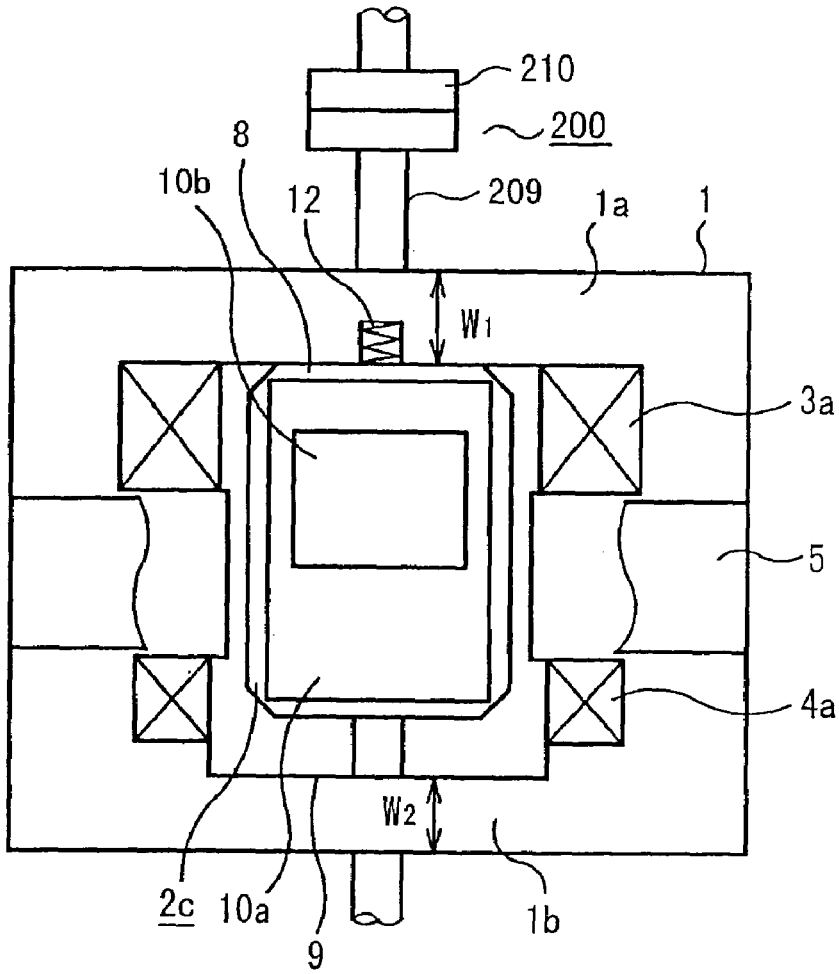
FIGS. 5A–5B are diagrams showing a magnetic actuator according to a second embodiment of the invention employing a magnetic actuator which is used also in one variation of the first embodiment of the invention.

There is formed an opening 10*b* in each end plate 10*a* by punching out a particular part of its entire surface as shown in FIG. 5A. A magnetic actuator 100 according to this variation of the first embodiment employing the armature 2*c* of FIGS. 5A–5B will be later described with reference to the second embodiment. A reason why such openings 10*b* are made in the end plates 10*a* is as follows. When the armature 2*c* is held at the second position 9 (open contact position), a small holding force is needed. The gaps formed between the permanent magnet 6 and the armature 2*c* when it is held at the second position 9 are therefore increased to reduce fluxes formed from the permanent magnet 6 to the armature 2*c* and thereby improve the control characteristics of the magnetic actuator 100. Thus, the opening 10*b* is formed where it is located closest to the permanent magnets 6 when the armature 2*c* is held at the second position 9 and the size of the opening 10*b* is made generally equal to the facing surface area of each permanent magnet 6.

Figure 6A:
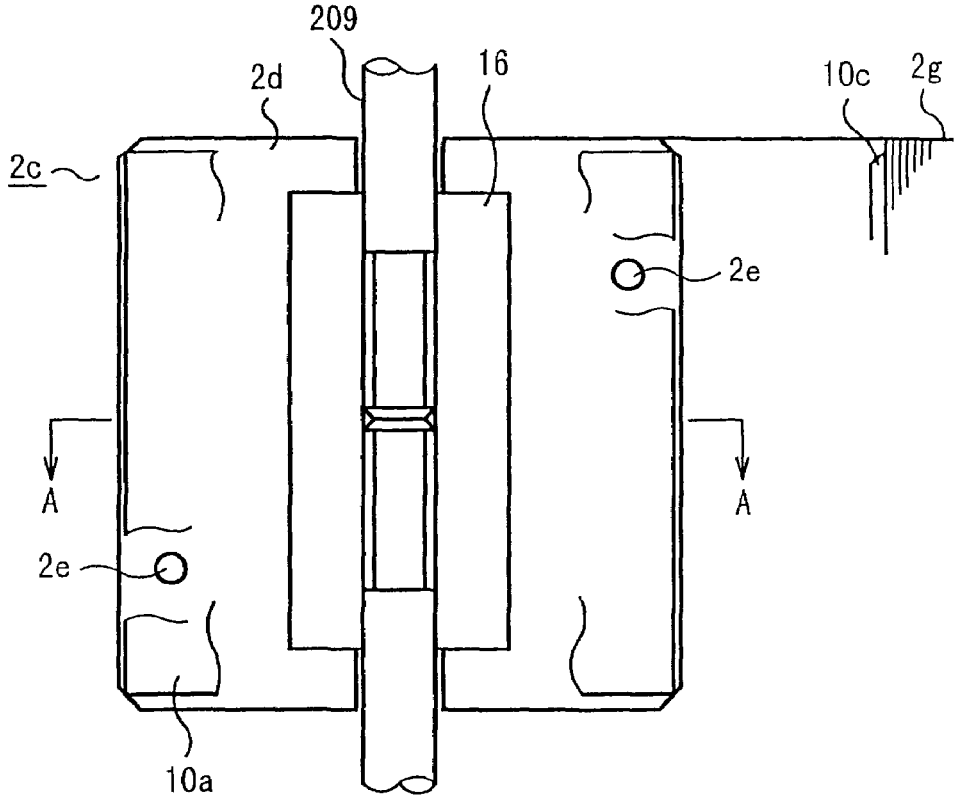
FIGS. 6A–6C are diagrams showing the construction of the armature according to the variation of the first embodiment of FIGS. 5A–5B.
Figure 6B:
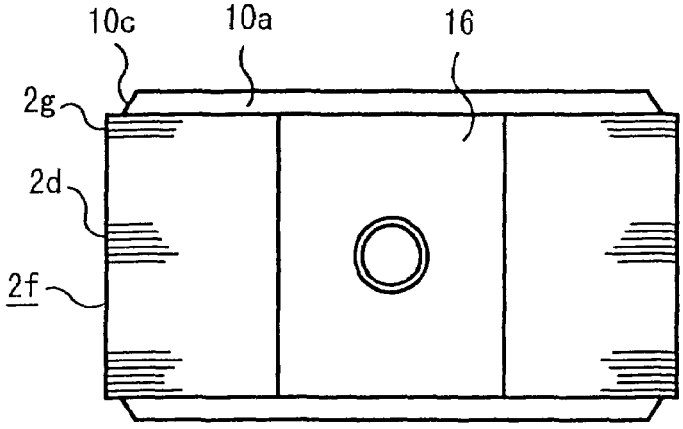
Figure 6C:
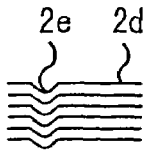

The construction of the armature 2*c* is now described in detail referring to FIGS. 6A–6C.

FIG. 6A is a sectional view of the armature 2*c*, FIG. 6B is a sectional view taken along lines A—A of FIG. 6A, and FIG. 6C is a diagram showing how later-described laminations 2*d* of the armature 2*c* having recesses 2*e* are stacked together.

The armature 2*c* includes a parallelepiped-shaped core 16 fixedly screwed on the actuator rod 209, a laminated block 2*f* built up of the aforementioned laminations 2*d* each formed of a pair of generally C-shaped sheets fixed to the core 16, and the aforementioned end plates 10*a* for binding the laminated block 2*f*. The recess 2*e* is formed in each sheet of the laminations 2*d*, and when the laminations 2*d* are stacked, the recesses 2*e* are matched to align the individual laminations 2*d* with high accuracy and to prevent the laminations 2*d* from being displaced when any external force is exerted on the laminated block 2*f*.

As depicted in FIG. 6B, peripheral surfaces 10*c* of each end plate 10*a* are positioned slightly on the inside of end surfaces 2*g* of the laminated block 2*f*. The peripheral surfaces 10*c* of the end plates 10*a* thus situated serve to decrease a stress which could occur at edges of the laminations 2*d*.

The principle of operation of the magnetic actuator 100 is now described with reference to FIGS. 8A–8C, although it is basically the same as explained earlier in connection with prior art technology.

Figure 8A:
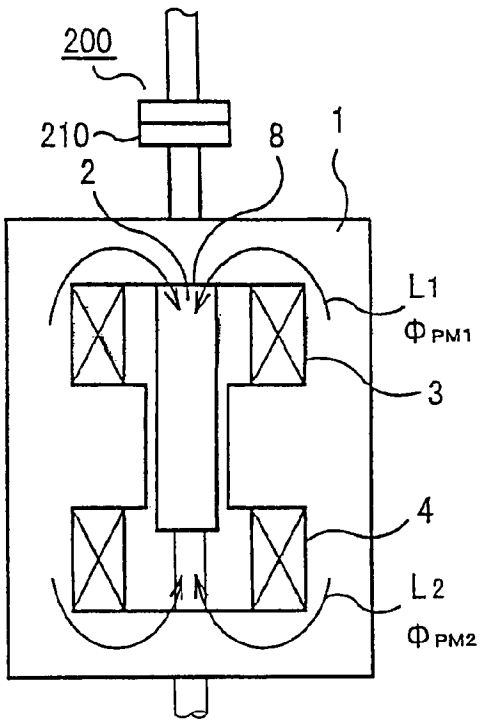
FIGS. 8A–8C are diagrams showing the principle of operation of the magnetic actuators according to the first to sixth embodiments of the invention.
Figure 8B:
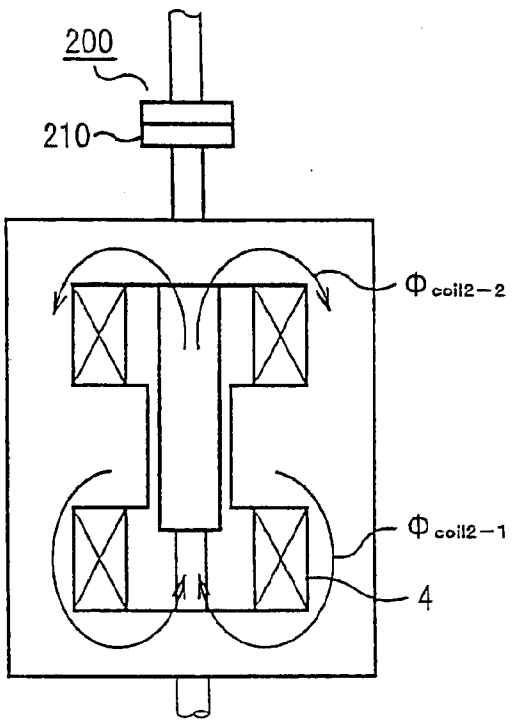

(1) The contacts 210 of the circuit breaker 200 are in a closed position in FIG. 8A, in which the armature 2 is held at the first position 8 adjacent to the upper yoke section la of the first yoke 1 and neither the first coil 3 nor the second coil 4 is excited. Under these conditions, the permanent magnets 6 generate fluxes $\Phi_{PM1}$ and $\Phi_{PM2}$ passing through magnetic circuits L1 and L2, respectively. Since there is the second air gap G2 in the magnetic circuit L2 as shown in FIG. 3A, the flux $\Phi_{PM1}$ passing through the magnetic circuit L1 having a lower reluctance is much greater than the flux $\Phi_{PM2}$ passing through the magnetic circuit L2 having a higher reluctance ($\Phi_{PM1} >> \Phi_{PM2}$). As a consequence, an attractive force occurs between the armature 2 and the first yoke 1. This magnetic attractive force can be expressed by the same equation as shown in the background art description.

(2) When the second coil 4 is excited in a manner that it produces a magnetic field of the same polarity as that created by the permanent magnets 6, fluxes $\Phi coil_{2-1}$ and $\Phi coil_{2-2}$ as shown in FIG. 8B are generated. These fluxes $\Phi coil_{2-1}$, $\Phi coil_{2-2}$ are combined with the fluxes $\Phi_{PM1}$, $\Phi_{PM2}$ generated by the permanent magnets 6. If a relationship expressed by $\Phi_{PM2}+\Phi coil_{2-1} > \Phi_{PM1}-\Phi coil_{2-2}$ is satisfied, there occurs a force pulling the armature 2 toward the second position 9 adjacent to the lower yoke section 1*b* of the first yoke 1.

Figure 8C:
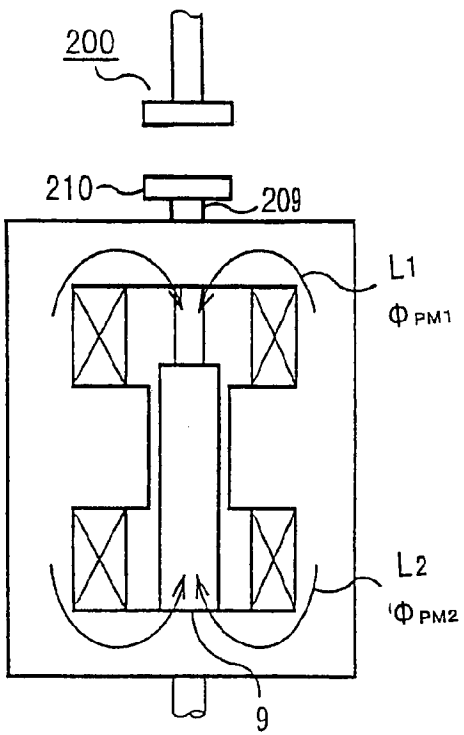

(3) When the armature 2 comes apart from the first position 8 adjacent to the upper yoke section 1*a* of the first yoke 1, the sum of the fluxes $\Phi_{PM2}+\Phi coil_{2-1}$ becomes much greater than the sum of the fluxes $\Phi_{PM1}-\Phi coil_{2-2}$ ($\Phi_{PM2}+\Phi coil_{2-1} >> \Phi_{PM1}-\Phi coil_{2-2}$), whereby the armature 2 is caused to move by as much as the aforementioned specific stroke and reach the second position 9 adjacent to the lower yoke section 1*b* of the first yoke 1 as shown in FIG. 8C.

(4) If the second coil 4 is de-excited at this point, the armature 2 is held at the second position 9 adjacent to the lower yoke section 1*b* of the first yoke 1 as shown in FIG. 8C.

(5) To bring the armature 2 from the position shown in FIG. 8C back to the position shown in FIG. 8A, the first coil 3 is excited to cause the armature 2 to move upward by as much as the same specific stroke.

The contacts 210 of the circuit breaker 200 connected to the armature 2 are opened and closed as the armature 2 moves up and down within the first yoke 1 in the aforementioned manner, whereby a current in an electric power transmission and distribution system is interrupted and flowed.

Here, the first and second gaps G1, G2 formed between the first yoke 1 and the armature 2 in the present embodiment are described in further detail.

The first air gap G1 is the distance between the armature 2 and the upper yoke section 1*a* of the first yoke 1 shown in FIG. 3B and the second air gap G2 is the distance between the armature 2 and the lower yoke section 1*b* of the first yoke 1 shown in FIG. 3A. An air gap G2-t shown in FIG. 3A is the distance between the armature 2 and a spacer 13 made of aluminum, stainless steel or copper, for example, which is provided on the lower yoke section 1*b*.

For the sake of explanation in this Specification, the first and second gaps G1, G2 are referred to as magnetic gaps and the air gap G2-t is referred to as a mechanical air gap. The second air gap G2 is larger than first air gap G1 (G2>G1) and G2=G1+t. The aforementioned specific stroke of the armature 2 takes the value G2-t which is equal to G1.

As will be later discussed with reference to FIGS. 5A–5B, G1 may be made equal to G2 (G1=G2) when a force for holding the circuit breaker 200 in its open contact position can be reduced by allowing the fluxes to escape through other than a contact surface of the armature 2 (2*c*) or when the force for holding the circuit breaker 200 in its open contact position can be reduced by making the vertical thickness $W_1$ of the upper yoke section la larger than the vertical thickness $W_2$ of the lower yoke section 1*b*.

The first air gap G1 is made unequal to the second air gap G2 in this embodiment because the aforementioned force for holding the armature 2 (2*c*) in its open contact position may be remarkably smaller than a force for holding the armature 2 (2*c*) in its closed contact position and, thus, the force for holding the armature 2 (2*c*) at the upper first position 8 to hold the contacts 210 in their closed state differs from the force for holding the armature 2 (2*c*) at the lower second position 9 to hold the contacts 210 in their open state. As it is only necessary to prevent the armature 2 (2*c*) from accidentally flipping to the closed contact position in the event of earthquakes, for instance, the force for holding the armature 2 (2*c*) at the open contact position may be sufficiently smaller than the force for holding the armature 2 (2*c*) at the closed contact position.

It is possible to optimize the armature holding forces and thereby achieve an improvement in control characteristics of the magnetic actuator 100 by properly determining the amount of the first or second gap G1, G2 so that the permanent magnets 6 generate fluxes suitable for holding the armature 2 (2*c*) in position according to the open and closed states of the contacts 210 of the magnetic actuator 100.

Although G2>G1 in the first embodiment, the invention is not limited thereto. Depending on positional relationship between the magnetic actuator 100 and the circuit breaker 200, a spacer 13 made of a nonmagnetic material may be provided on the upper yoke section 1*a*.

Figure 5B:
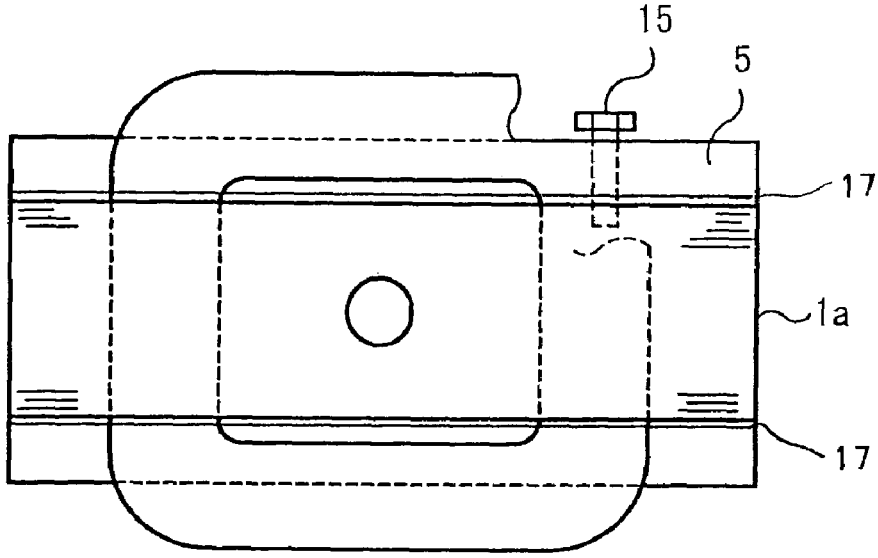

Also, the thickness $W_1$ of the upper yoke section 1*a* may be made equal to the thickness $W_2$ of the lower yoke section 1*b* (W1=W2) when the force for holding the circuit breaker 200 in its open contact position can be reduced by allowing the fluxes to escape through other than the contact surface of the armature 2 (2*c*) or when the force for holding the circuit breaker 200 in its open contact position can be reduced by making the first air gap G1 larger than the second air gap G2 as will be later discussed with reference to FIGS. 5A–5B.

Second Embodiment

A magnetic actuator 100 according to the second embodiment of the invention is described with reference to FIGS. 5A–5B and 7A–7B.

FIG. 5A is a sectional front view of the magnetic actuator 100 and FIG. 5B is a side view of the same. The second yokes 5 are partially cut away in FIG. 5A.

Referring to FIG. 5A, the magnetic actuator 100 includes a first yoke 1 formed of an upper yoke section 1*a*, a lower yoke section 1*b* and side yoke sections 1*c*, an armature 2*c*, a first coil 3*a*, a second coil 4*a*, a pair of end plates 10*a* in which openings 10*b* are formed, a spring 12 provided between the upper yoke section 1*a* and the armature 2*c*, and a jack bolt 15 provided in one of the second yokes 5. As stated earlier with reference to the first embodiment, $W_1$ indicates the vertical thickness of the upper yoke section 1*a* and $W_2$ indicates the vertical thickness of the lower yoke section 1*b*.

As previously mentioned, the force needed for holding the contacts 210 of the circuit breaker 200 in the open position may be sufficiently smaller than the force needed for holding them in the closed position. Therefore, the flux density of a magnetic field generated through the lower yoke section 1*b* may be small when the armature 2*c* is held at the second position 9 adjacent to the lower yoke section 1*b* than when the armature 2*c* is held at the first position 8 adjacent to the upper yoke section 1*a*. This means that the thickness $W_2$ of the lower yoke section 1*b* of the first yoke 1 measured in the earlier mentioned first direction may be made smaller than the thickness $W_1$ of the upper yoke section 1*a*.

According to the invention, the armature holding forces can be adjusted by reducing the thickness $W_2$ of the lower yoke section 1*b* in this fashion, thereby enabling a reduction in the weight of the magnetic actuator 100.

Since the spring 12 provided between the upper yoke section 1*a* and the armature 2*c* assists the armature 2*c* in moving from the first position 8 to the second position 9, magnetomotive force (AT) produced by the second coil 4*a* may be made smaller than that produced by the first coil 3*a*. It is therefore possible to reduce the cross-sectional area and size of the second coil 4*a*, the overall size and weight of the magnetic actuator 100 and the capacity of a power supply (not shown).

Figure 7A:
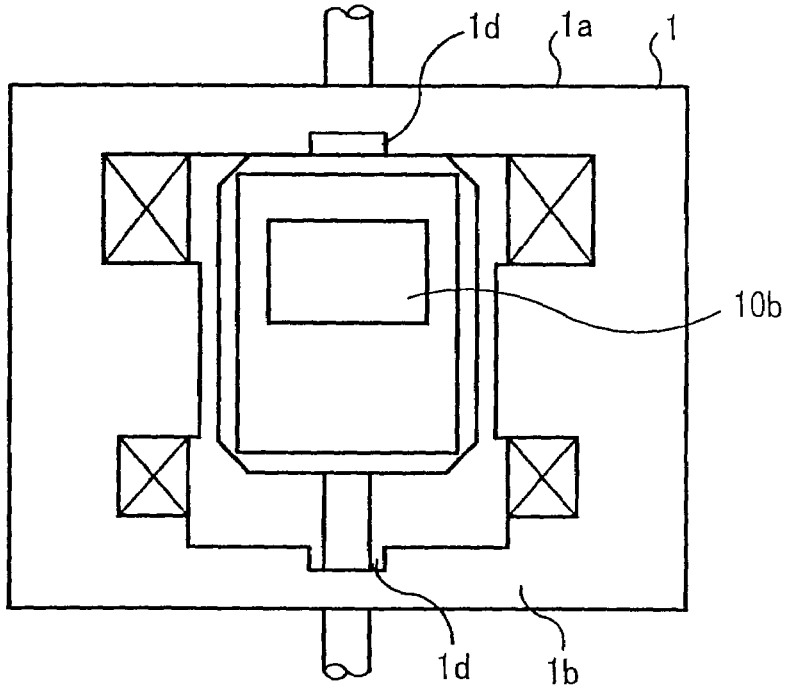
FIGS. 7A–7B are sectional diagrams showing a magnetic actuator according to the second embodiment of the invention.
Figure 7B:
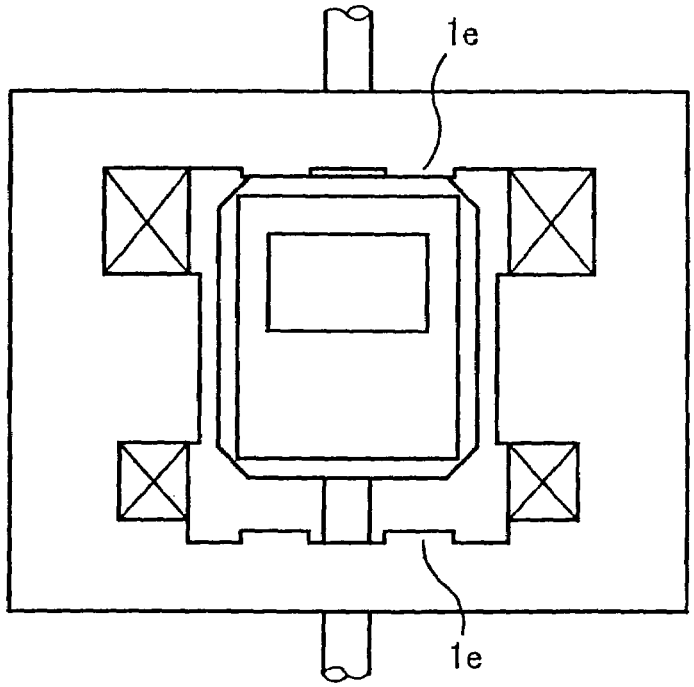

In one alternative, recesses 1*d* may be formed in the upper yoke section 1*a* and the lower yoke section 1*b* of the first yoke 1 as shown in FIG. 7A to adjust surface areas of the upper yoke section 1*a* and the lower yoke section 1*b* that come in direct contact with the armature 2*c* by air gaps partially created between them. These recesses 1*d* in the upper yoke section 1*a* and the lower yoke section 1*b* of the first yoke 1 serve to regulate the armature holding forces. In another alternative, projections 1*e* may be formed on the upper yoke section 1*a* and the lower yoke section 1*b* of the first yoke 1 as shown in FIG. 7B to regulate the armature holding forces in a similar fashion.

Furthermore, an extra gap may be formed between the first yoke 1 and one of the second yokes 5 by operating the jack bolt 15 provided in one second yoke 5 as depicted in FIG. 5B. This increases the air gap between the armature 2*c* and the permanent magnet 6 attached to the second yoke 5, making it possible to insert additional thin magnetic steel or thin steel sheets (not shown) in the extra gap thus created. This arrangement makes the air gap between the armature 2*c* and the permanent magnet 6 variable, thereby allowing adjustment of the armature holding forces.

Third Embodiment

Although each of the second yokes 5 is shaped in an elongate parallelepipedic form in the aforementioned first and second embodiments, a magnetic actuator 100 according to the third embodiment discussed below employs E-shaped second yokes 5*a* each having three inward projecting portions as shown in FIG. 9. A permanent magnet 6*a* is attached to the central projecting portion of each second yoke 5*a* as illustrated. When assembled into the magnetic actuator 100, the permanent magnets 6*a* on the individual second yokes 5*a* are positioned face to face with the armature 2 with air gaps g created in between.

The two second yokes 5*a* are affixed to the side yoke sections 1*c* of the first yoke 1 by bolts or fastening parts which are not illustrated. The second yokes 5*a* may be made of solid steel plates or laminations of thin magnetic steel or thin steel sheets.

Figure 10A:
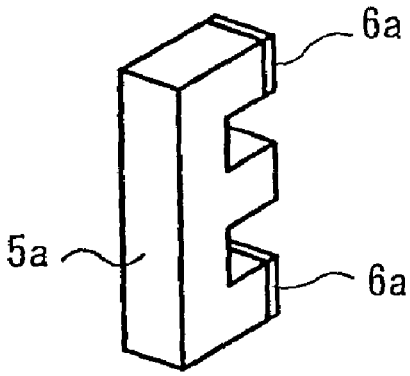
FIGS. 10A–10F are perspective views of second yokes applicable to the magnetic actuator of the third embodiment.
Figure 10B:
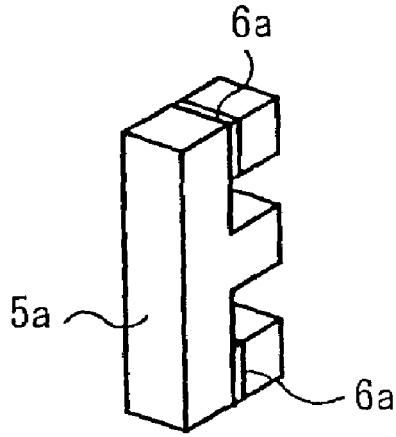
Figure 10C:
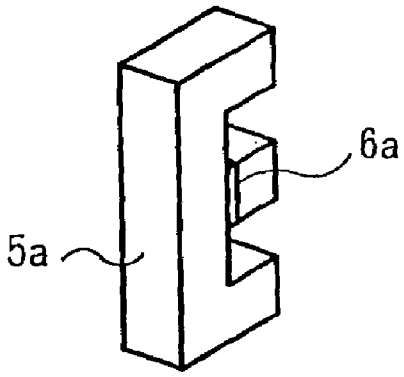
Figure 10D:
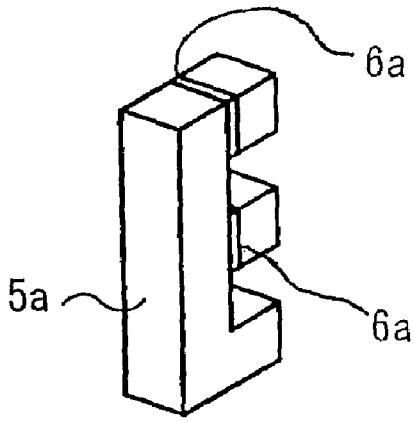
Figure 10E:
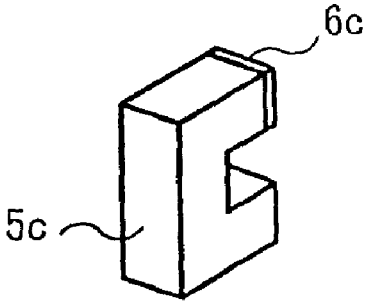
Figure 10F:
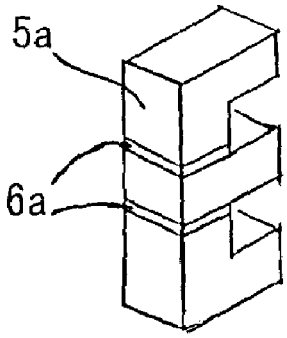

Alternatively, two permanent magnets 6*a* may be affixed to far ends of the outer projecting portions of each second yoke 5*a* as shown in FIG. 10A or, although not illustrated, to portions of inner surfaces of the first yoke 1 that face extreme outer ends of the two outer projecting portions of each second yoke 5*a*. Still alternatively, two permanent magnets 6*a* may be placed at the bases of the outer projecting portions of each second yoke 5*a* as shown in FIG. 10B or at the base of the central projecting portion of each second yoke 5*a* as shown in FIG. 10C. Yet still alternatively, two permanent magnets 6*a* may be positioned as illustrated in FIG. 10D or 10F or a single permanent magnet 6*c* may be placed as illustrated in FIG. 10E. In the structures shown in FIGS. 9 and 10A–10F, one or two permanent magnets 6*a* are positioned at end surfaces of elements constituting part of second magnetic circuits passing through each second yoke 5*a* or sandwiched by such elements.

According to the embodiment, the permanent magnets 6*a* should be located in the second magnetic circuits formed through the second yokes 5*a* and the armature 2 and not in the first magnetic circuits formed through the first yoke 1 and the armature 2 by excitation of the first or second coil 3, 4.

Fourth Embodiment

While two second yokes 5 (5*a*) are oriented along the aforementioned second direction in the magnetic actuators 100 of the first to third embodiments, E-shaped second yokes 5*b* are positioned along the aforementioned first (vertical) direction and fixed to an upper yoke section 1*a* and a lower yoke section 1*b* of a first yoke 1 by bolts or fastening parts (not shown) in a magnetic actuators 100 according to the fourth embodiment described below.

Figure 11:
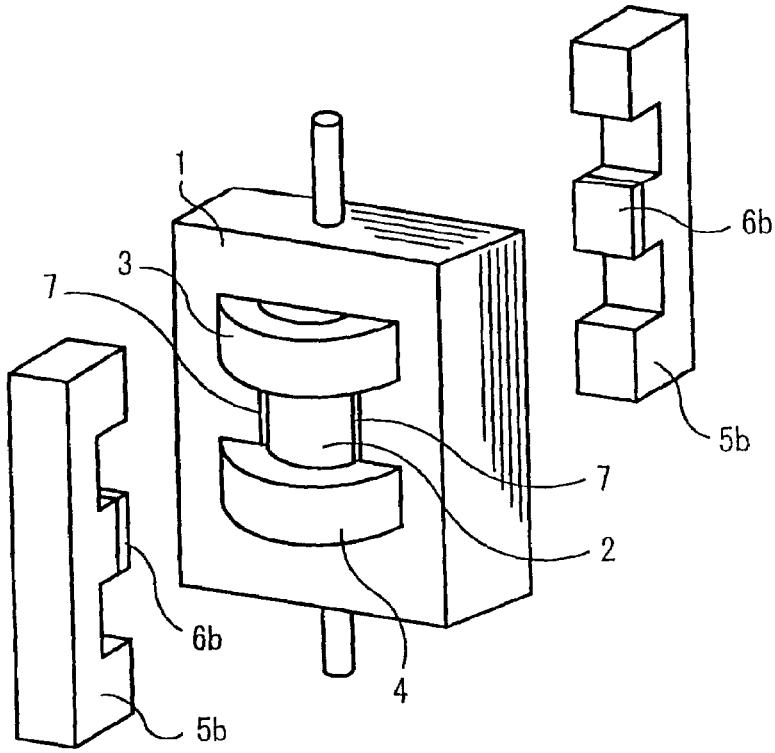
FIG. 11 is a partially exploded perspective view of the magnetic actuator according to the fourth embodiment of the invention.
Figure 12:
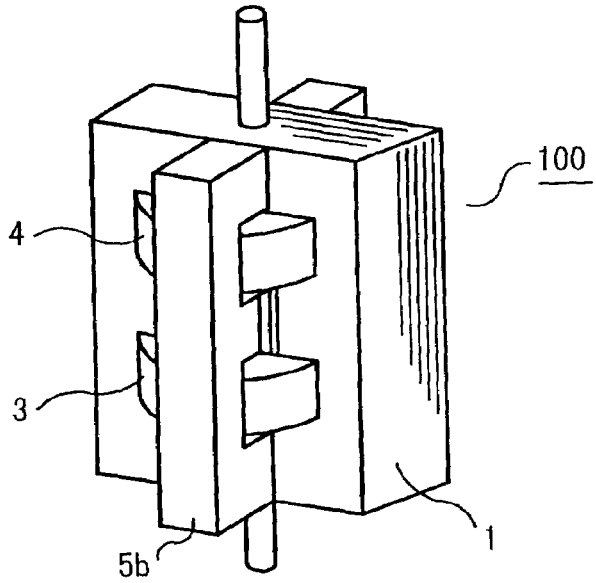
FIG. 12 is a perspective view of the magnetic actuator of the fourth embodiment.

FIG. 11 is a partially exploded perspective view of the magnetic actuator 100 of the fourth embodiment, and FIG. 12 is a perspective view of the magnetic actuator 100.

A permanent magnet 6*b* is attached to a central projecting portion of each second yoke 5*b*. When the second yokes 5*b* are fixed to the first yoke 1, their permanent magnets 6*b* face an armature 2 across air gaps g. It is to be noted that the second yokes 5*b* are not necessarily limited to the structure shown in FIG. 11 but may be configured as shown in FIGS. 10A–10F.

The second yokes 5*b* may be made of solid steel plates or laminations of thin magnetic steel or thin steel sheets. Furthermore, although there is provided a pair of second yokes 5*b* in the present embodiment, the number of the second yokes 5*b* is not necessarily limited to two, but just a single second yoke 5*b* may be provided on one side of the first yoke 1.

Fifth Embodiment

Figure 13:
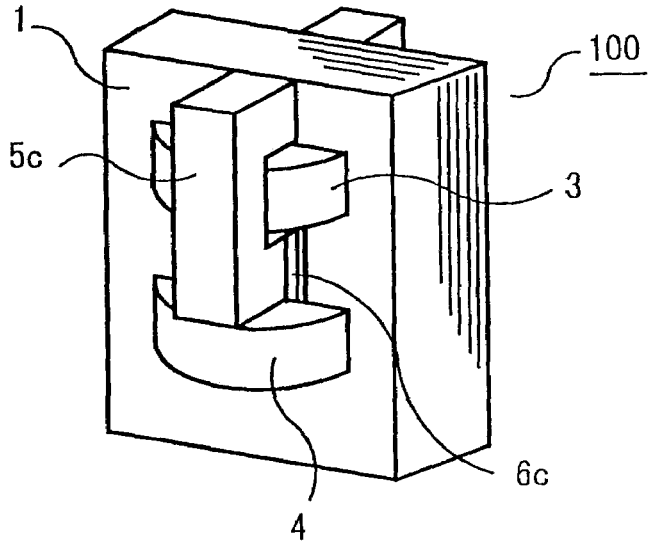
FIG. 13 is a perspective view of the magnetic actuator according to the fifth embodiment of the invention.

FIG. 13 is a perspective view of a magnetic actuator according to the fifth embodiment of the invention, in which second yokes 5*c* are C-shaped and oriented along the aforementioned first (vertical) direction of a first yoke 1.

The second yokes 5*c* are positioned to hold a first coil 3 inside their C-shape as shown in FIG. 13 with an upper projecting part of each second yoke 5*c* fixed to an upper yoke section 1*a* of the first yoke 1. A permanent magnet 6*c* is attached to a lower projecting part of each second yoke 5*c* and positioned face to face with an armature 2 as illustrated. Alternatively, the permanent magnet 6*c* may be placed as shown in FIG. 10E.

As in the foregoing embodiments, the second yokes 5*c* may be, made of solid steel plates or laminations of thin magnetic steel or thin steel sheets. While the second yokes 5*c* are fixed to the upper yoke section 1*a* in the example shown in FIG. 13, they may be fixed to a lower yoke section 1*b* of the first yoke 1. Furthermore, although there is provided a pair of second yokes 5*c* in the present embodiment, the number of the second yokes 5*c* is not necessarily limited to two, but just a single second yoke 5*c* may be provided on one side of the first yoke 1.

Sixth Embodiment

Figure 14:
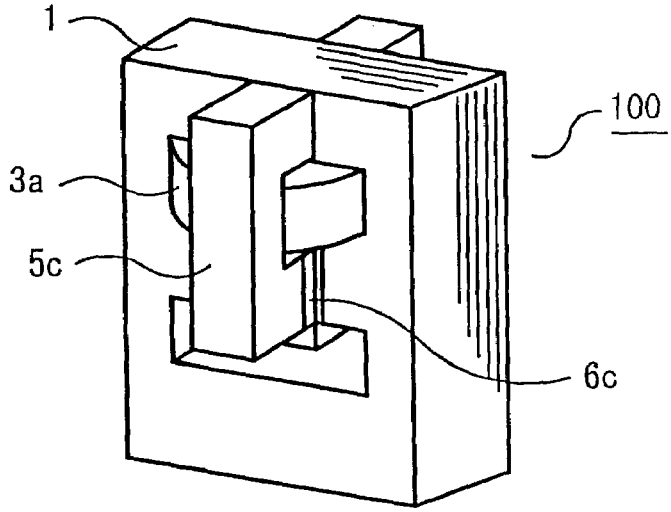
FIG. 14 is a perspective view of the magnetic actuator according to the sixth embodiment of the invention.
Figure 15:
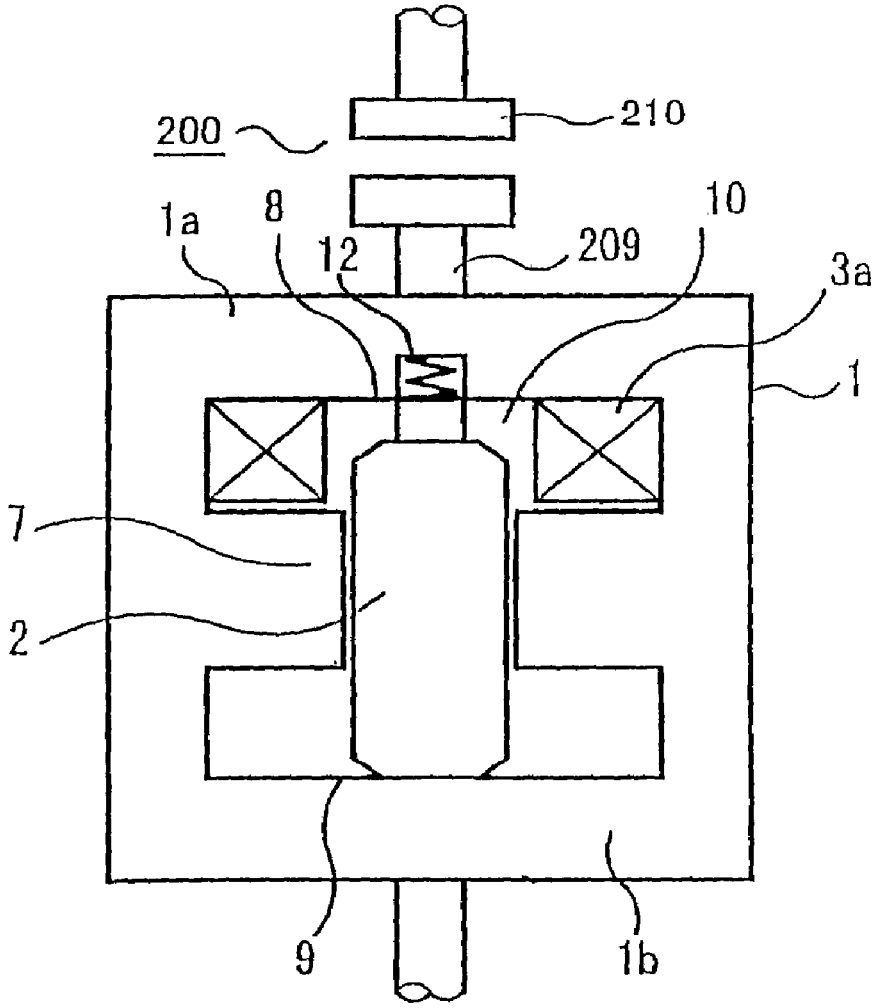
FIG. 15 is a sectional diagram showing a yoke and armature arrangement of the magnetic actuator of the sixth embodiment.

FIG. 14 is a perspective view of a magnetic actuator 100 according to the sixth embodiment of the invention which is provided with just a single exciting coil 3*a* in a first yoke 1. As shown in FIG. 15, there is provided a spring 12 at a first position 8 between an upper yoke section 1*a* of the first yoke 1 and an armature 2.

Figure 16A:
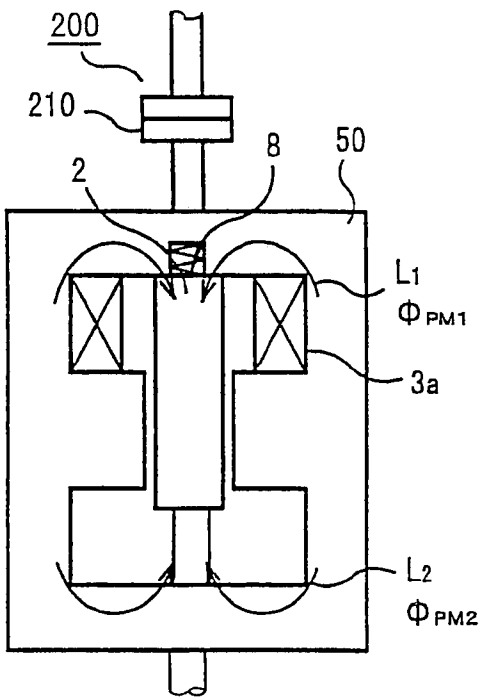
FIGS. 16A–16C are diagrams showing the principle of operation of the magnetic actuator of the sixth embodiment.
Figure 16B:
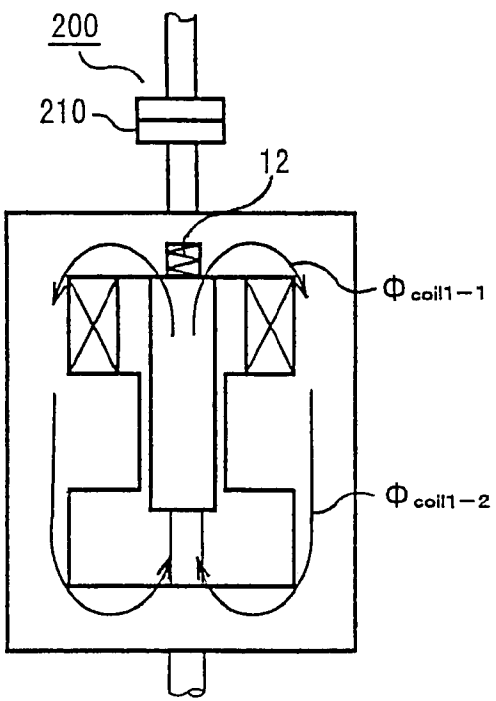
Figure 16C:
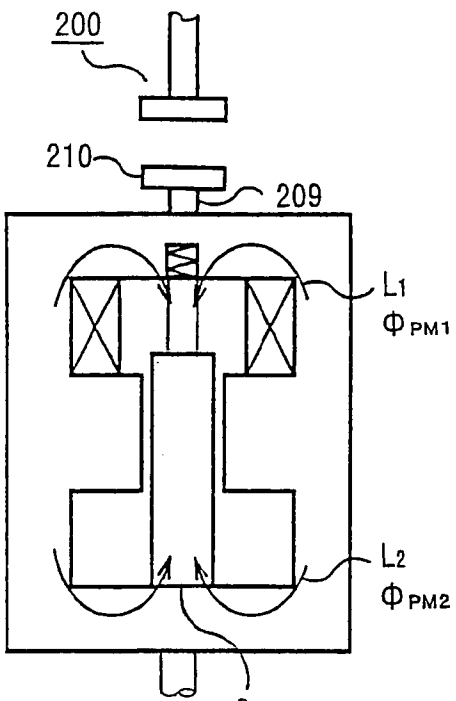

Operation of the magnetic actuator 100 is now described with reference to FIGS. 14, 15 and 16A–16C. FIG. 15 shows a state corresponding to FIG. 16C in which contacts 210 of a circuit breaker 200 are in an open position. In this state, the armature 2 is held at a second position 9 adjacent to a lower yoke section 1*b* of the first yoke 1 by flux $\Phi_{PM2}$ generated by the permanent magnets 6*c* shown in FIG. 14. To switch the circuit breaker 200 from the open position of the contacts 210 to a closed contact position, the coil 3*a* is reversely excited so that magnetic fields oriented in directions opposite to arrows shown in FIG. 16B are created. Consequently, the sum of magnetic attractive forces exerted by flux $\Phi_{coil1\text{-}2}$ produced by the coil 3*a* and flux $\Phi_{PM2}$ produced by the permanent magnets 6*c* decreases and the armature 2 moves from the second position 9 to the first position 8 over a specific stroke. When switching the circuit breaker 200 from the closed contact position shown in FIG. 16A to the open contact position shown in FIG. 16C by moving the armature 2 downward, the exciting coil 3*a* is excited to generate flux $\Phi_{coil1\text{-}1}$. The flux $\Phi_{coil1\text{-}1}$ should be just large enough to cancel the attractive force exerted by the flux $\Phi_{PM1}$ produced by the permanent magnets 6*c* for holding the armature 2 at the first position 8 adjacent to the upper yoke section 1*a*. As the attractive force exerted by the flux $\Phi_{PM1}$ is canceled in this fashion, the spring 12 provided between the upper yoke section 1*a* and the armature 2 causes the armature 2 to move downward toward the second position 9 adjacent to the lower yoke section 1*b*.

The foregoing construction of the present embodiment makes it possible to decrease magnetomotive force for exciting the coil 3*a* so that the magnetic actuator 100 can be made compact and to reduce the capacity of a coil exciting power supply.

Figure 19:
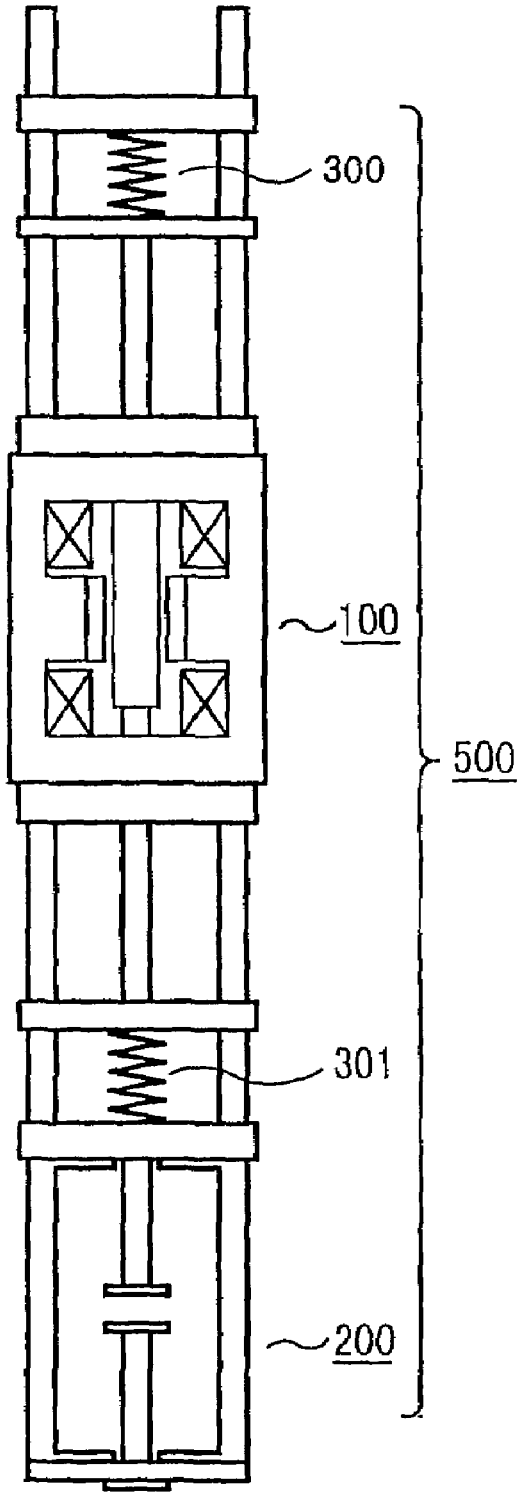
FIG. 19 is a diagram generally showing the construction of a conventional circuit breaker system.

While second yokes 5*c* are fixed to the upper yoke section 1*a* as shown in FIG. 14 in this embodiment, they may be fixed to the lower yoke section 1*b* in a variation thereof. Although the spring 12 is provided between the upper yoke section 1*a* and the armature 2 in this embodiment, the spring 12 may be provided between the lower yoke section 1*b* and the armature 2 depending on the balance of force between assist springs 300 and 301 of a circuit breaker system 500 (refer to FIG. 19). Furthermore, the spring 12 need not necessarily be provided between the upper yoke section 1*a* or the lower yoke section 1*b* and the armature 2 but may be provided outside the first yoke 1 if it is arranged to exert a force moving the armature 2 in the aforementioned first direction. As an alternative, a pneumatically operated mechanism or an elastic member made of rubber, for example, may be used instead of the spring 12. Furthermore, although the second yokes 5*c* are C-shaped and oriented along the first (vertical) direction of the first yoke 1 in the sixth embodiment, they may be parallelepiped- or E-shaped and oriented along the aforementioned second (horizontal) direction.

Although the magnetic actuator 100 of this embodiment is provided with the single exciting coil 3*a*, there may be provided first and second coils 3, 4 as shown in the first embodiment or more than two exciting coils.

While the magnetic actuators 100 of the invention have thus far been described with reference to specific examples used for actuating the circuit breaker 200 of the circuit breaker system 500 for making and breaking an electric circuit, the invention is not limited to this application. The magnetic actuators 100 of the invention can be used in various kinds of equipment involving reciprocal motions, such as devices for opening and closing valves in a liquid or gas transport line or for opening and closing doors. According to the invention, it is not absolutely necessary to provide the springs 300 and 301 used in the conventional arrangement shown in FIG. 19, so that the circuit breaker system 500 can be made compact.

The invention claimed is:

1. A magnetic actuator comprising:

a first yoke including an assembly of laminated metal sheets;

a second yoke affixed to the first yoke, wherein the first yoke has a first surface perpendicular to a lamination direction of the metal sheets and the second yoke is attached to the first surface of the first yoke;

a permanent magnet;

an armature located inside the first yoke and movable in reciprocating motion over a stroke between a first position and a second position, along a first direction; and at least one coil, wherein a flux generated by the at least one coil passes through a first magnetic circuit including the armature and the first yoke to move the armature toward one of the first and second positions, and a flux generated by the permanent magnet passes through a second magnetic circuit including the permanent magnet, the first yoke, the second yoke, and the armature to hold the armature at one of the first and second positions.

2. The magnetic actuator according to claim 1, wherein the permanent magnet is located between the first yoke and the second yoke, at an end surface of the second yoke facing the armature.

3. The magnetic actuator according to claim 1, including a second magnetic air gap between the second position and an end surface of the armature facing the second position when the armature is held at the first position, and a first magnetic air gap, differing from the second magnetic air gap, between the first position and an end surface of the armature facing the first position when the armature is held at the second position.

4. The magnetic actuator according to claim 1, wherein the second yoke is oriented along the first direction.

5. A magnetic actuator comprising:

a first yoke including an assembly of laminated metal sheets;

a second yoke affixed to the first yoke;

a permanent magnet;

an armature located inside the first yoke and movable in reciprocating motion over a stroke between a first position and a second position, along a first direction, wherein the second yoke is oriented along a second direction which is perpendicular to the first direction; and at least one coil, wherein a flux generated by the at least one coil passes through a first magnetic circuit including the armature and the first yoke to move the armature toward one of the first and second positions, and a flux generated by the permanent magnet passes through a second magnetic circuit including the permanent magnet, the first yoke, the second yoke, and the armature to hold the armature at one of the first and second positions.

6. The magnetic actuator according to claim 1, wherein the second yoke includes an assembly of laminated metal sheets.

7. The magnetic actuator according to claim 1, wherein a first yoke section of the first yoke at the second position of the armature has a smaller cross-sectional area than a second yoke section of the first yoke at the first position of the armature.

8. The magnetic actuator according to claim 1, wherein the first yoke has stepped surfaces creating a partial air gap between the first yoke and the armature when the armature is held at either of the first and second positions.

9. The magnetic actuator according to claim 1 further comprising a jack bolt fitted to the second yoke, wherein the permanent magnet is affixed to the second yoke and an air gap between the armature and the permanent magnet can be varied by operating the jack bolt, so a metal sheet can be inserted between the second yoke and the first yoke.

10. The magnetic actuator according to claim 1, wherein the at least one coil includes multiple coils.

11. The magnetic actuator according to claim 1, wherein an end portion of the armature through which the fluxes pass, facing the first yoke, has a smaller cross-sectional area than other portions of the armature through which the fluxes pass.

12. The magnetic actuator according to claim 1, wherein the armature includes an assembly of laminated metal sheets.

13. The magnetic actuator according to claim 12, wherein the laminated metal sheets are bound together with solid end plates at both ends of the assembly of the laminated metal sheets.

14. The magnetic actuator according to claim 13, wherein peripheral surfaces of each of the end plates are positioned inside of end surfaces of the assembly of laminated metal sheets.

15. The magnetic actuator according to claim 1, wherein the permanent magnet is located within the first yoke and the second yoke, and between elements of the second yoke.

16. The magnetic actuator according to claim 1, further comprising an actuating mechanism moving the armature along the first direction.

17. The magnetic actuator according to claim 1, including a first coil and a second coil fitted to the first yoke.

18. The magnetic actuator according to claim 1, wherein the permanent magnet is located in the second magnetic circuit, which is distinct from the first magnetic circuit.

19. A magnetic actuator comprising:

an armature located inside the first yoke and movable in reciprocating motion over a stroke between a first position and a second position, along a first direction;

a coil surrounding the armature;

a first yoke including an assembly of laminated metal sheets and having an end face facing a side face of the armature, the first yoke including a holding part for holding the armature and an extending part extending from the end face to the holding part along an outer circumference of the coil;

a permanent magnet; and a second yoke including a mounting part attached to the first yoke and a connecting part connected to the permanent magnet, wherein the first yoke has a first surface perpendicular to a lamination direction of the metal sheets, and the second yoke is attached to the first surface of the first yoke.

20. The magnetic actuator according to claim 17, wherein a magnetomotive force produced by the first coil differs from a magnetomotive force produced by the second coil.

* * * * *